US011897719B2

(12) United States Patent
Fukui et al.

(10) Patent No.: US 11,897,719 B2
(45) Date of Patent: Feb. 13, 2024

(54) POST-PROCESSING APPARATUS AND IMAGE FORMING SYSTEM

(71) Applicant: FUJIFILM Business Innovation Corp., Tokyo (JP)

(72) Inventors: Eri Fukui, Kanagawa (JP); Takayuki Fukamachi, Kanagawa (JP); Koji Kawano, Kanagawa (JP); Yuki Mizuno, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/939,579

(22) Filed: Sep. 7, 2022

(65) Prior Publication Data

US 2023/0211973 A1 Jul. 6, 2023

(30) Foreign Application Priority Data

Jan. 4, 2022 (JP) ..... 2022-000046

(51) Int. Cl.
*B65H 39/10* (2006.01)
*B65H 37/04* (2006.01)
*B65H 29/58* (2006.01)

(52) U.S. Cl.
CPC ..... *B65H 39/10* (2013.01); *B65H 29/58* (2013.01); *B65H 37/04* (2013.01); *B65H 2301/435* (2013.01); *B65H 2301/4316* (2013.01); *B65H 2404/7414* (2013.01); *B65H 2801/06* (2013.01); *B65H 2801/27* (2013.01)

(58) Field of Classification Search
CPC ..... B41L 43/02; B41L 43/06; B41L 43/10; B41L 43/12; B65H 29/26; B65H 29/58; B65H 29/66; B65H 31/06; B65H 2301/435; B65H 2301/4505; B65H 2801/27
USPC ..... 270/37
See application file for complete search history.

(56) References Cited

U.S. PATENT DOCUMENTS 7,165,764 B2 * 1/2007 Nakamura ..... B65H 31/3027 271/189
7,556,251 B2 * 7/2009 Kamiya ..... G03G 15/6505 270/58.08
7,575,230 B2 * 8/2009 Kamiya ..... G03G 15/6541 270/58.1
7,588,241 B2 * 9/2009 Murata ..... B42C 1/00 270/58.11
8,292,285 B2 * 10/2012 Yokoya ..... G03G 15/6547 271/286
8,844,921 B2 * 9/2014 Okumura ..... B42C 1/125 270/58.11
9,045,308 B2 * 6/2015 Tamura ..... B65H 39/00
(Continued)

FOREIGN PATENT DOCUMENTS

JP 2013-56758 A 3/2013

*Primary Examiner* — Leslie A Nicholson, III
(74) *Attorney, Agent, or Firm* — Oliff PLC

(57) ABSTRACT

A post-processing apparatus includes: a buffer unit that transports sheets such that at least two of the sheets are transported while being stacked on top of one another, the sheets being sent to the buffer unit from an image forming unit; and a compilation tray that is inclined with respect to a direction opposite to a direction in which the sheets are transported in the buffer unit such that the sheets, which are supplied from the buffer unit, are transported into the compilation tray from above the compilation tray and stacked onto a placement surface as a stack of sheets.

8 Claims, 7 Drawing Sheets

(56) References Cited

U.S. PATENT DOCUMENTS

| | | | | |
|---|---|---|---|---|
| 9,302,879 | B2 * | 4/2016 | Matsumoto | G03G 15/5062 |
| 9,517,652 | B2 * | 12/2016 | Kubota | B65H 5/06 |
| 9,897,962 | B2 * | 2/2018 | Osada | B65H 45/04 |
| 9,932,199 | B2 * | 4/2018 | Katsumata | B65H 45/18 |
| 9,988,231 | B2 * | 6/2018 | Nakano | B65H 29/54 |

* cited by examiner

POST-PROCESSING APPARATUS AND IMAGE FORMING SYSTEM

CROSS-REFERENCE TO RELATED APPLICATIONS

This application is based on and claims priority under 35 USC 119 from Japanese Patent Application No. 2022-000046 filed Jan. 4, 2022.

BACKGROUND

(i) Technical Field

The present disclosure relates to a post-processing apparatus and an image forming system.

(ii) Related Art

There is known a post-processing apparatus including a stack-of-sheets forming unit that forms a stack of sheets by allowing a plurality of sheets to be stacked thereon, a binding unit that drives a binding needle through the stack of sheets formed by the stack-of-sheets forming unit and bends the ends of the binding needle so as to bind the stack of sheets, a folding unit that performs folding on a portion of the stack of sheets, the portion having been bound with the binding needle, and a needle detection unit that is disposed further downstream than the binding unit in a direction in which the stack of sheets is transported and further upstream than the folding unit in the direction and that detects the binding needle driven through the stack of sheets by the binding unit (Japanese Unexamined Patent Application Publication No. 2013-56758).

SUMMARY

Aspects of non-limiting embodiments of the present disclosure relate to providing a post-processing apparatus and an image forming system capable of arranging sheets that are included in a booklet in order.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided including: a buffer unit that transports sheets such that at least two of the sheets are transported while being stacked on top of one another, the sheets being sent to the buffer unit from an image forming unit; and a compilation tray that is inclined with respect to a direction opposite to a direction in which the sheets are transported in the buffer unit such that the sheets, which are supplied from the buffer unit, are transported into the compilation tray from above the compilation tray and stacked onto a placement surface as a stack of sheets.

BRIEF DESCRIPTION OF THE DRAWINGS

An exemplary embodiment of the present disclosure will be described in detail based on the following figures, wherein.

DETAILED DESCRIPTION

Figure 1:
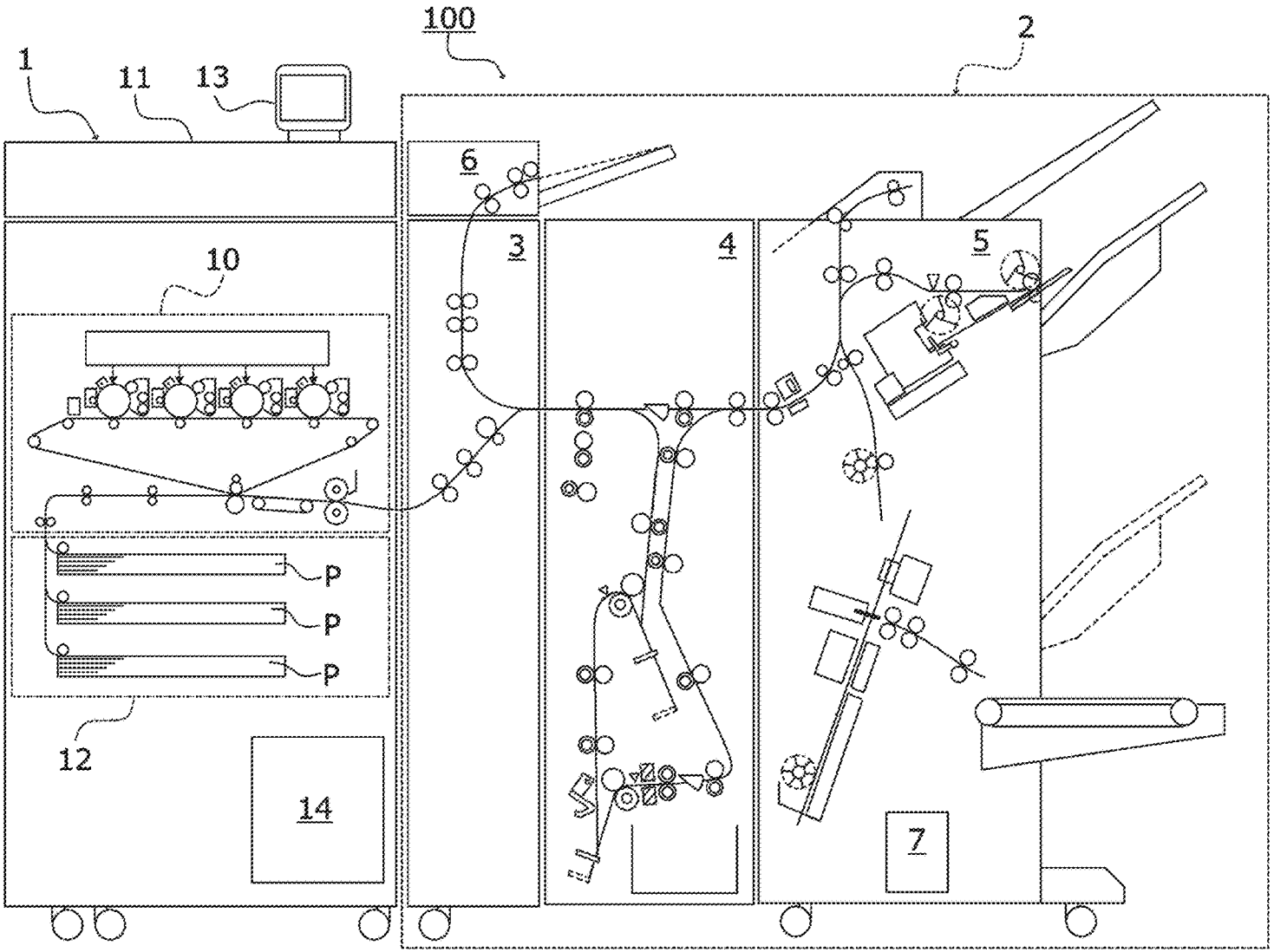
FIG. 1 is a schematic diagram illustrating a configuration of an image forming system to which a post-processing apparatus according to an exemplary embodiment of the present disclosure is applied.

Although an exemplary embodiment of the present disclosure will be described in detail below using a specific example and with reference to the drawings, the present disclosure is not limited to the exemplary embodiment and the specific example.

In addition, in the drawings that will be referred to in the following description, objects are schematically illustrated, and it should be noted that dimensional ratios and so forth of the objects that are illustrated in the drawings are different from those of actual objects. Furthermore, for ease of understanding, illustration of components that are not necessary for the following description is suitably omitted in the drawings.

(1) Overall Configuration and Operation of Image Forming System

FIG. 1 is a schematic diagram illustrating a configuration of an image forming system 100 to which a post-processing apparatus according to the present exemplary embodiment is applied. The image forming system 100 illustrated in FIG. 1 includes an image forming apparatus 1, such as a printer or a copying machine, that employs an electrophotographic system and forms an image and a post-processing apparatus 2 that performs post-processing on at least one of sheets P on which toner images have been formed by the image forming apparatus 1.

The image forming apparatus 1 includes an image forming device 10 that forms an image on the basis of image data, an image reading device 11 that generates read image data by reading an image from a document, a sheet-feeding device 12 that feeds the sheets P to the image forming section 10, a user interface 13 that receives an operation input from a user of the image forming system 100 and performs display of various information items to the user, and a controller 14 that performs overall operational control of the image forming system 100.

The image forming device 10 includes photoconductors. A charging unit, an exposure unit, a developing unit, a transfer unit, and a cleaning unit are arranged around each of the photoconductors. Each of the charging units uniformly charges the corresponding photoconductor. Each of the exposure units causes a light beam to scan on the basis of image data. Each of the developing units develops, with a toner, an electrostatic latent image that is formed as a result of the corresponding exposure unit performing scanning and irradiation. Each of the transfer units transfers a toner image developed on the corresponding photoconductor to one of the sheets P. Each of the cleaning units cleans the surface of the corresponding photoconductor after transfer of a toner image. The image forming device 10 further includes a fixing unit disposed on a transport path along which the sheets P are transported, and the fixing unit fixes a toner image that has been transferred to one of the sheets P onto the sheet P.

The post-processing apparatus 2 includes a transport device 3, a folding device 4, and a finisher device 5. The transport device 3 receives the sheets P on which images have been formed from the image forming apparatus 1 and transports the sheet P. The folding device 4 performs a folding operation on each of the sheets P that are transported thereto from the transport device 3. The finisher device 5 performs a final operation on each of the sheets P that have passed through the folding device 4.

The post-processing apparatus 2 further includes an interposer 6 and a sheet-processing controller 7. The interposer 6 supplies a laminated sheet that is used for making, for example, a cover of a booklet. The sheet-processing controller 7 controls each functional unit of the post-processing apparatus 2. Note that, although FIG. 1 illustrates the configuration in which the sheet-processing controller 7 is disposed in the post-processing apparatus 2, the sheet-processing controller 7 may be disposed in the image forming apparatus 1. Alternatively, the controller 14 that is included in the image forming apparatus 1 and that performs overall operational control of the image forming system 100 may have the control function of the sheet-processing controller 7.

(2) Post-Processing Apparatus

Figure 2:
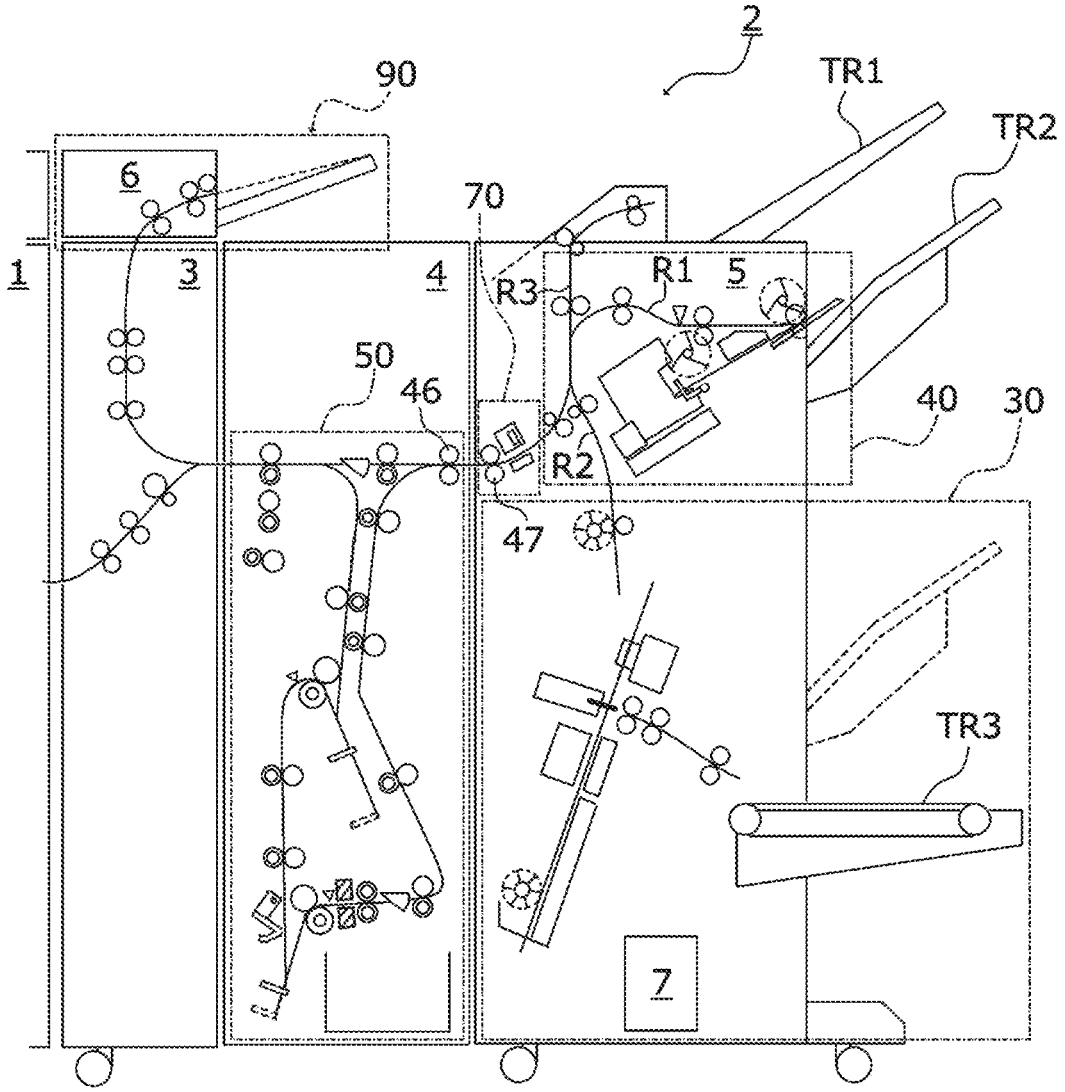
FIG. 2 is a diagram illustrating functions of the post-processing apparatus according to the present exemplary embodiment.
Figure 3:
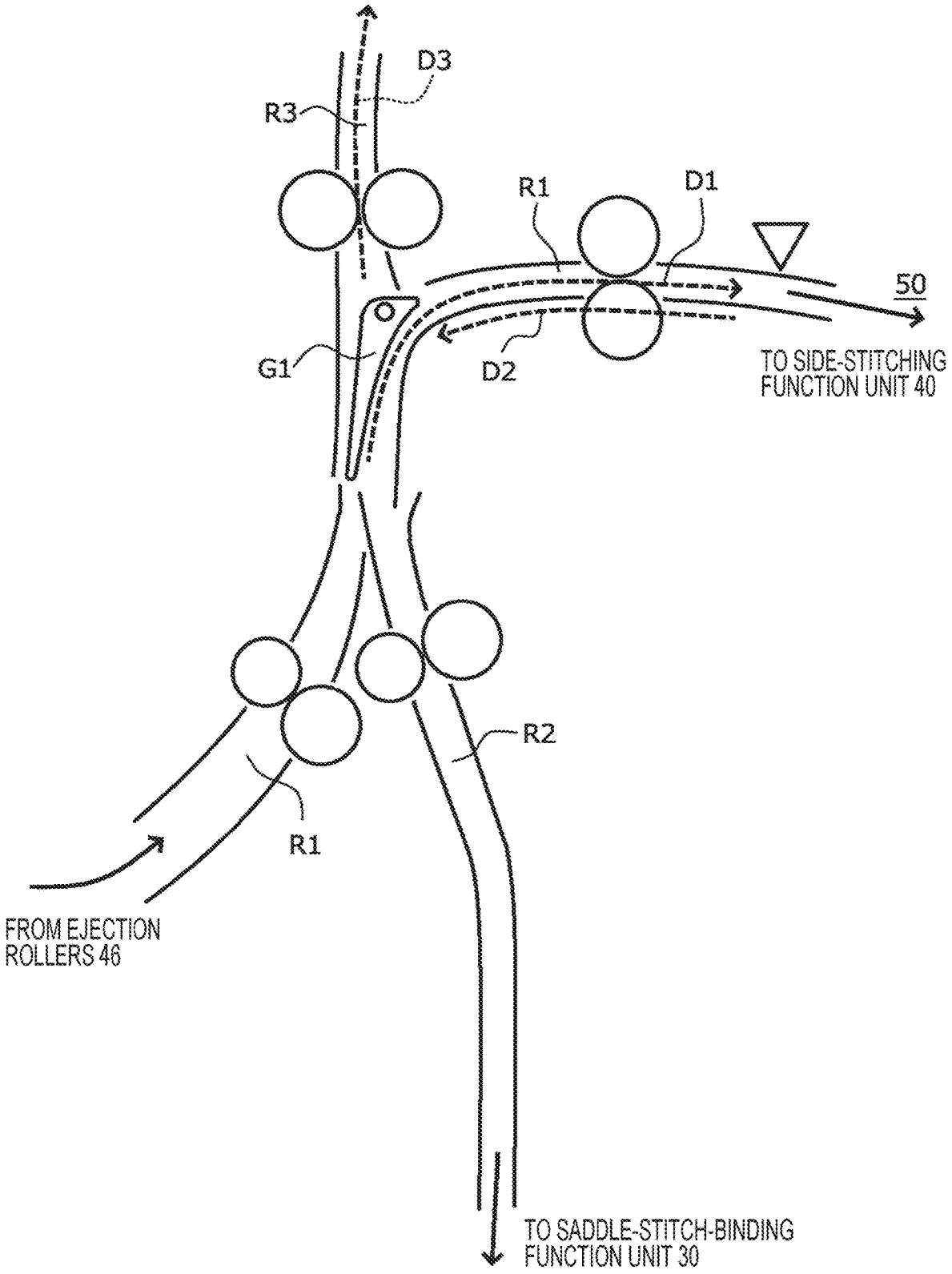
FIG. 3 is a diagram illustrating transportation of a sheet in a finisher device.

FIG. 2 is a diagram illustrating functions of the post-processing apparatus 2, and FIG. 3 is a diagram illustrating transportation of one of the sheets P in the finisher device 5.

In the post-processing apparatus 2, the finisher device 5 includes a punching function unit 70, a side-stitching function unit 40, and a saddle-stitch-binding function unit 30. The punching function unit 70 performs punching on the sheets P (punches, for example, two holes or four holes in the sheets P). The side-stitching function unit 40 allows a necessary number of the sheets P to be stacked on top of one another so as to form a stack of sheets PB (see FIG. 4) and performs a binding operation (side stitching) on an end portion of the stack of sheets PB. The saddle-stitch-binding function unit 30 allows a necessary number of the sheets P to be stacked on top of one another so as to form the stack of sheets PB and performs a binding operation (saddle stitching) on a center portion of the stack of sheets PB so as to bind a brochure (a booklet).

The finisher device 5 includes a first sheet-transport path R1, a second sheet-transport path R2, and a third sheet-transport path R3 as sheet transport units, and these sheet-transport paths R1 to R3 are arranged downstream from receiving rollers 47 that receive the sheets P that are sent into the finisher device 5 by ejection rollers 46 of the folding device 4. The first sheet-transport path R1, the second sheet-transport path R2, and the third sheet-transport path R3 are configured to be selected by a switching gate G1 (see FIG. 3).

The first sheet-transport path R1 transports the sheets P that are sent thereto through the receiving rollers 47 to the side-stitching function unit 40 (in a sheet-transport direction D1 in FIG. 3).

The second sheet-transport path R2 branches off from the first sheet-transport path R1 and is connected to the saddle-stitch-binding function unit 30. A booklet produced by the saddle-stitch-binding function unit 30 is ejected to a booklet tray TR3 (see FIG. 2). The second sheet-transport path R2 temporarily holds at least one of the sheets P that is reversed in the first sheet-transport path R1 and transported (in a sheet-transport direction D2 in FIG. 3). In the present exemplary embodiment, the first sheet-transport path R1 and the second sheet-transport path R2 form a buffer unit that allows some of the sheets P to be stacked on top of one another and transported.

The third sheet-transport path R3 branches off from the first sheet-transport path R1 and is connected to a top tray TR1 (see FIG. 2), and the sheets P that are not subjected to the post-processing are ejected from the third sheet-transport path R3 (in a sheet-transport direction D3 in FIG. 3).

The folding device 4 includes a folding function unit 50 that performs folding such as a letter fold (a C fold) or an accordion fold (a Z fold) on at least one of the sheets P.

The interposer 6 or the transport device 3 includes a laminated-sheet supply function unit 90 that supplies a laminated sheet such as a thick sheet or a sheet with an opening that is used for a cover of a booklet, which is formed by binding the stack of sheets PB.

(2.1) Configuration of Saddle-Stitch-Binding Function Unit

Figure 4:
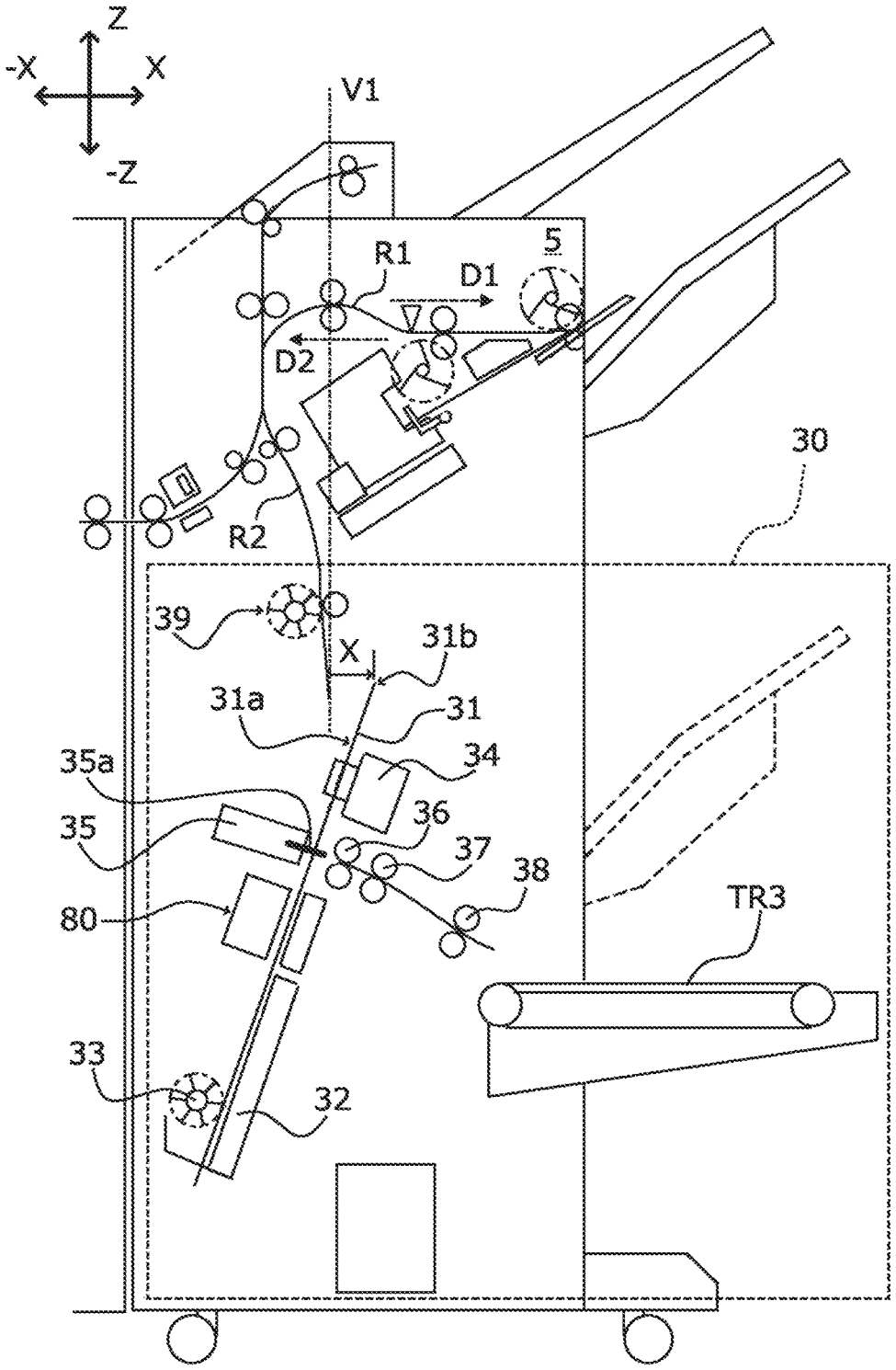
FIG. 4 is a diagram illustrating a configuration of a saddle-stitch-binding function unit according to the present exemplary embodiment.

FIG. 4 is a diagram illustrating the configuration of the saddle-stitch-binding function unit 30 according to the present exemplary embodiment.

As illustrated in FIG. 4, the saddle-stitch-binding function unit 30 that binds the stack of sheets PB into a booklet includes a compilation tray 31, a transport roller 39, and an end guide 32. The compilation tray 31 allows a predetermined number of the sheets P on each of which an image has been formed to be stacked thereon. The transport roller 39 transports the sheets P one at a time into the compilation tray 31. The end guide 32 moves along the compilation tray 31 while the stack of sheets PB is placed on a positioning stopper, which is provided on the compilation tray 31 in a protruding manner, and determines a saddle-stitching position and a folding position of the stack of sheets PB.

The saddle-stitch-binding function unit 30 further includes a sheet-aligning paddle 33 and a sheet-width-aligning member 34. The sheet-aligning paddle 33 aligns the sheets P stacked on the compilation tray 31 toward the end guide 32. The sheet-width-aligning member 34 aligns the sheets P, which are stacked on the compilation tray 31, in a width direction of the sheets P.

In addition, the saddle-stitch-binding function unit 30 includes a stapler 80, a folding mechanism 35, and folding rollers 36. The stapler 80 performs a binding operation by driving a binding needle through the stack of sheets PB on the compilation tray 31. The folding mechanism 35 includes a folding knife 35*a* that moves with respect to the stack of sheets PB that has undergone the binding operation in such a manner as to project in a direction from the backside of the compilation tray 31 toward a placement surface 31*a* of the compilation tray 31. The folding rollers 36 are a pair of rollers and nip the stack of sheets PB once the folding knife 35*a* starts folding the stack of sheets PB.

The saddle-stitch-binding function unit 30 further includes transport rollers 37, the booklet tray TR3, and transport rollers 38. The transport rollers 37 are disposed downstream from the folding rollers 36 and transport the stack of sheets PB that has been folded into a booklet by the folding mechanism 35 and the folding rollers 36. The stack of sheets PB in the form of a booklet is to be placed on the booklet tray TR3, and the transport rollers 38 transport the stack of sheets PB to the booklet tray TR3.

As illustrated in FIG. 4, in the saddle-stitch-binding function unit 30 of the present exemplary embodiment, the compilation tray 31 is disposed in such a manner as to be inclined with respect to a direction opposite to the sheet-transport direction D2 in the first sheet-transport path R1 while the side on which the sheets P are transported into the compilation tray 31 is the upper side (in a Z direction in FIG. 4). In other words, when a vertical line V1 passing through the second sheet-transport path R2 is drawn, an upper end 31*b* of the compilation tray 31 is inclined with respect to the vertical line V1 in such a manner as to be positioned downstream from the sheets P in the sheet-transport direction D1 in the first sheet-transport path R1 (denoted by X in FIG. 4).

As a result, the placement surface 31*a* on which the sheets P are to be placed as the stack of sheets PB is located on a side opposite to the side on which the stack of sheets PB that has been folded is ejected, and the sheets P that are reversed and transported from the second sheet-transport path R2 are stacked onto the placement surface 31*a* in order.

(2.2) Compiling Operation of Saddle-Stitch-Binding Function Unit

Figure 6:
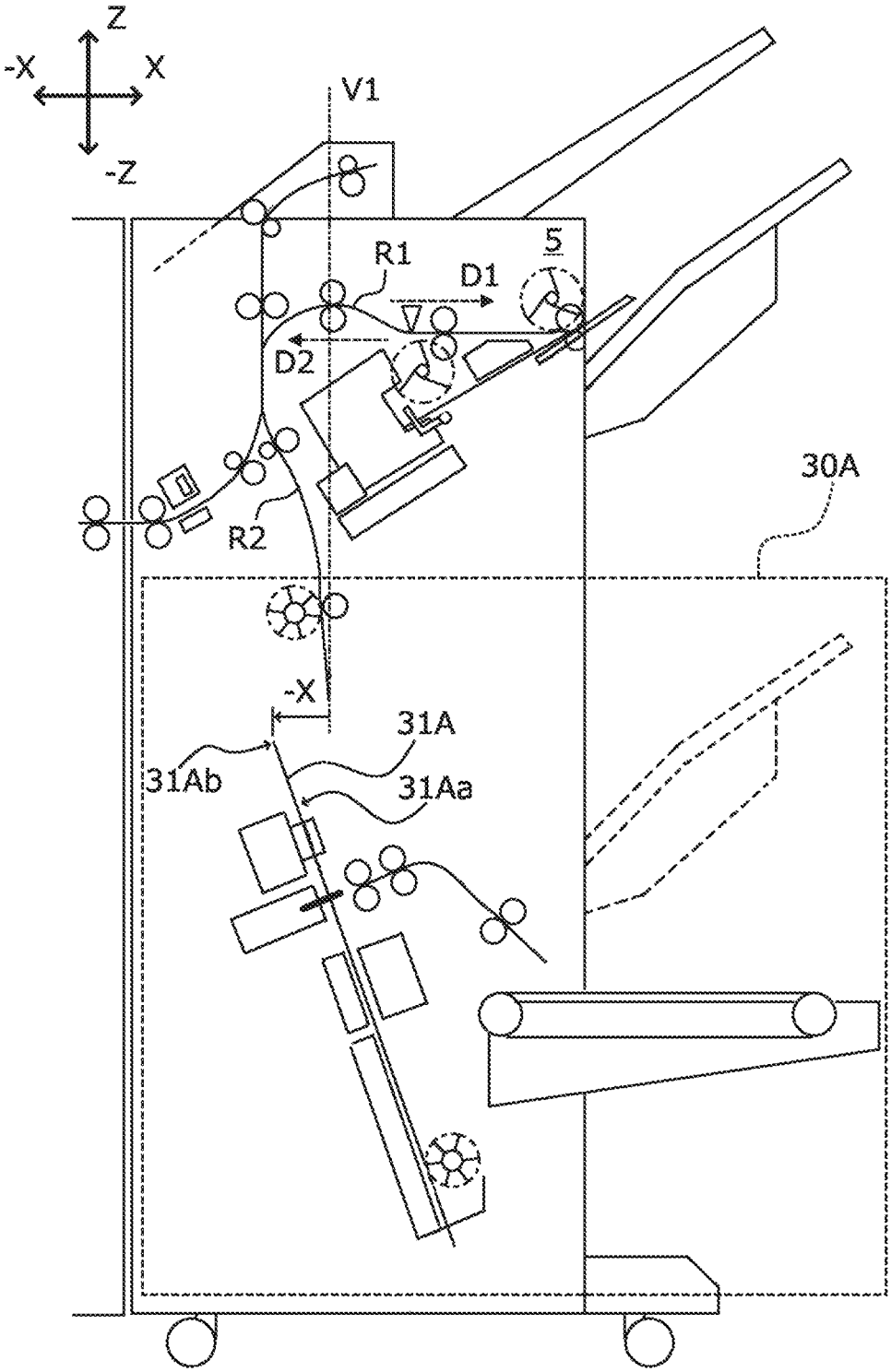
FIG. 6 is a diagram illustrating a configuration of a saddle-stitch-binding function unit of a comparative example.

FIG. 6 is a diagram illustrating a configuration of a saddle-stitch-binding function unit 30A of a comparative example in which a compilation tray 31A is disposed in such a manner as to be inclined with respect to a direction opposite to the sheet-transport direction D1 in the first sheet-transport path R1 while the side on which the sheets P are transported into the compilation tray 31A is the upper side (in the Z direction in FIG. 6). FIGS. 7A to 7D are diagrams illustrating sheet transportation in a compiling operation of the saddle-stitch-binding function unit 30A of the comparative example and a state where the sheets P are placed on a placement surface 31Aa.

In the saddle-stitch-binding function unit 30A of the comparative example, when the vertical line V1 passing through the second sheet-transport path R2 is drawn, an upper end 31*b* of the compilation tray 31A is inclined with respect to the vertical line V1 in such a manner as to be positioned upstream from the sheets P in the sheet-transport direction D1 in the first sheet-transport path R1 (denoted by −X in FIG. 6).

As a result, the placement surface 31Aa on which the sheets P are to be placed as the stack of sheets PB is located on the side on which the stack of sheets PB that has been folded is ejected, and the sheets P that are transported one at a time from the second sheet-transport path R2 are stacked onto the placement surface 31Aa in order.

In contrast, as illustrated in FIGS. 7A to 7D, when sheet buffering using switchback (reverse transportation) is performed in the buffer unit, the sheets P are not stacked in order onto the placement surface 31Aa.

Figure 7A:
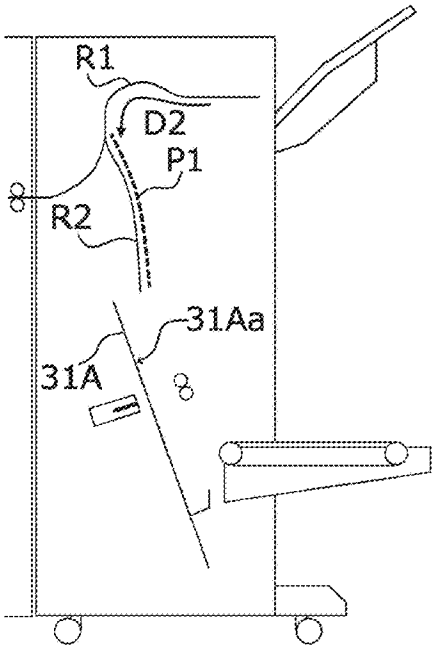
FIGS. 7A to 7D are diagrams illustrating sheet transportation in a compiling operation of the saddle-stitch-binding function unit of the comparative example and a state where sheets are placed on a placement surface.
Figure 7B:
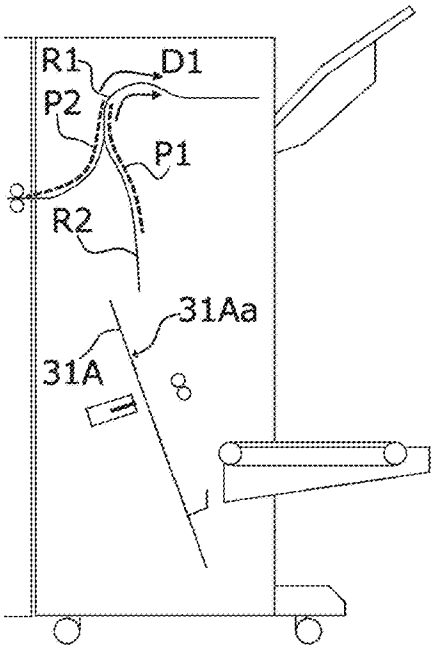
Figure 7C:
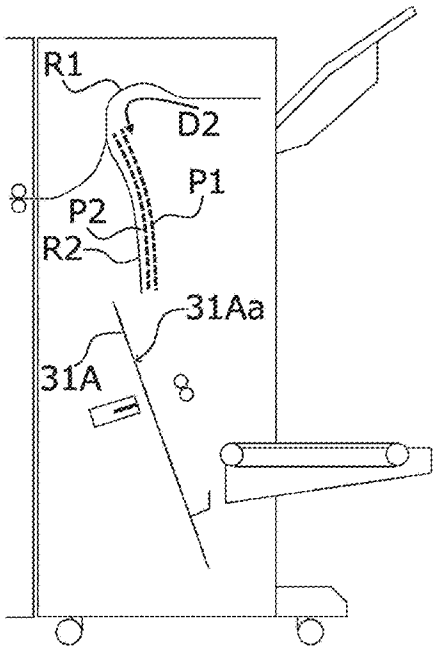

For example, in the case of performing single-sheet buffering (only the first sheet of a stack of sheets), a first sheet P1 is reversed, transported, and temporarily held in the second sheet-transport path R2, which forms part of the buffering unit, (see FIG. 7A), and the first sheet P1 held in the second sheet-transport path R2 is transported into the first sheet-transport path R1 in an opposite direction in accordance with the timing at which a second sheet P2 is transported into the first sheet-transport path R1 (see FIG. 7B). Then, the first sheet P1 and the second sheet P2 forming a single buffer are transported along the second sheet-transport path R2 at the same timing while being stacked one on top of the other into the compilation tray 31A (see FIG. 7C).

Figure 7D:
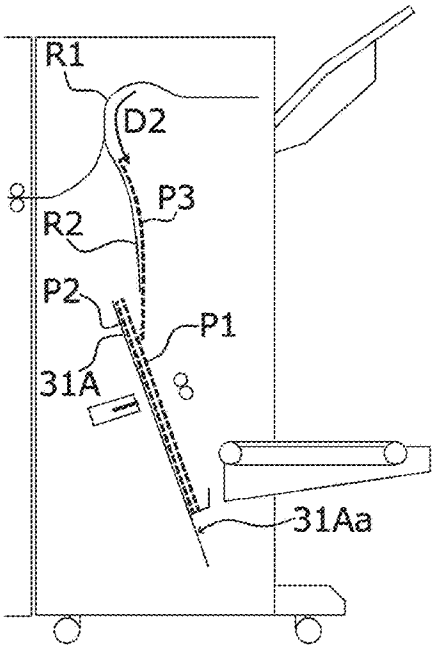

Subsequently, a third sheet P3 is reversed and transported along the first sheet-transport path R1 and the second sheet-transport path R2 to the compilation tray 31A (see FIG. 7D). When single-sheet buffering is performed in the manner described above, the sheets P1 to P3 are not stacked in order onto the compilation tray 31A, and the order in which these sheets are placed onto the compilation tray 31A is the second sheet P2, the first sheet P1, and the third sheet P3 starting from the placement-surface-31Aa side.

Similarly, in the case of performing double-sheet buffering (only the first and second sheets of a stack of sheets), the sheets P are not stacked in order onto the compilation tray 31A, and the order in which the sheets P are placed onto the compilation tray 31A is the third sheet, the second sheet, the first sheet, and the fourth sheet starting from the placement-surface-31Aa side.

Consequently, in the case of performing sheet buffering, for example, it is necessary to change the order of the sheets P on which images are to be formed in the image forming apparatus 1 in order to speed up saddle-stitch binding, which is performed as the post-processing.

FIGS. 5A to 5D are diagrams illustrating sheet transportation in the compiling operation of the saddle-stitch-binding function unit 30 according to the present exemplary embodiment and a state where the sheets P are placed on the placement surface 31*a*.

Figure 5A:
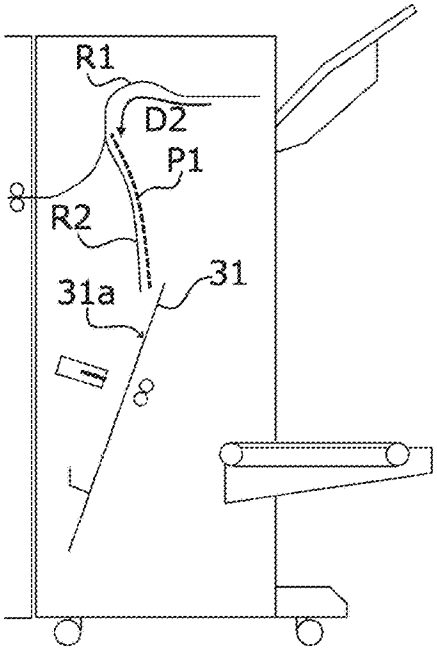
FIGS. 5A to 5D are diagrams illustrating sheet transportation in a compiling operation of the saddle-stitch-binding function unit according to the present exemplary embodiment and a state where sheets are placed on a placement surface.
Figure 5B:
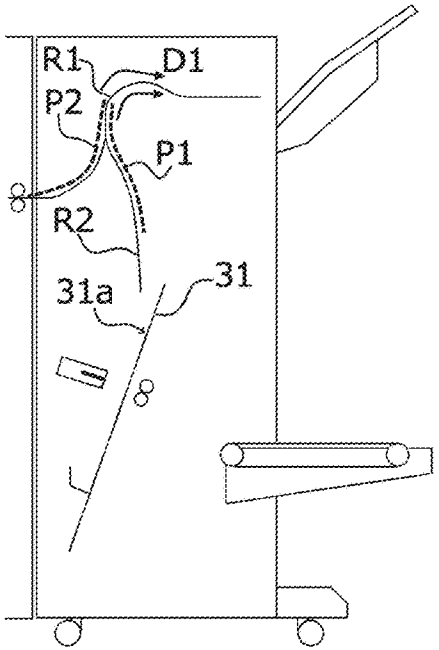

For example, in the case of performing single-sheet buffering (only the first sheet of a stack of sheets), the first sheet P1 is reversed, transported, and temporarily held in the second sheet-transport path R2, which forms part of the buffering unit, (see FIG. 5A), and the first sheet P1 held in the second sheet-transport path R2 is transported into the first sheet-transport path R1 in an opposite direction in accordance with the timing at which the second sheet P2 is transported into the first sheet-transport path R1 (see FIG. 5B).

Figure 5C:
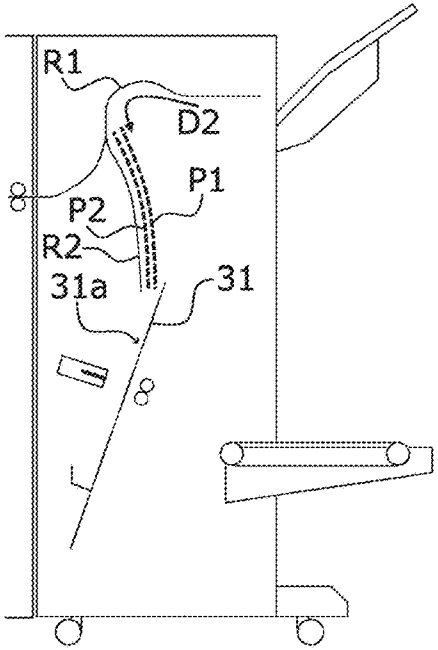

Then, the first sheet P1 and the second sheet P2 forming a single buffer are transported along the second sheet-transport path R2 at the same timing while being stacked one on top of the other into the compilation tray 31, so that the first sheet P1 is placed onto the placement surface 31*a*, and the second sheet P2 is stacked onto the first sheet P1 (see FIG. 5C).

Figure 5D:
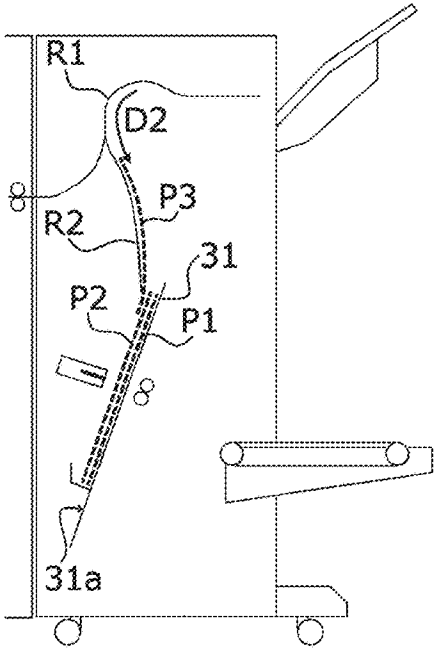

Subsequently, the third sheet P3 is reversed and transported along the first sheet-transport path R1 and the second sheet-transport path R2 to the compilation tray 31, so that the third sheet P3 is stacked onto the second sheet P2 (see FIG. 5D). As described above, even in the case of performing single-sheet buffering, the sheets P1 to P3 are stacked in order onto the compilation tray 31, that is, the order in which these sheets are placed onto the compilation tray 31 is the first sheet P1, the second sheet P2, and the third sheet P3 starting from the placement-surface-31*a* side.

Similarly, in the case of performing double-sheet buffering (only the first and second sheets of a stack of sheets), the sheets P are stacked in order onto the compilation tray 31, that is, the order in which the sheets P are placed onto the compilation tray 31 is the first sheet, the second sheet, the third sheet, and the fourth sheet starting from the placement-surface-31*a* side.

In the case where sheet buffering is not performed, the sheets P that are transported one at a time from the second sheet-transport path R2 are stacked in order onto the placement surface 31*a* that is, the order in which the sheets P are placed onto the compilation tray 31 is the first sheet, the second sheet, the third sheet, and so forth starting from the placement-surface-31*a* side.

As described above, according to the present exemplary embodiment, the compilation tray 31 is disposed in such a manner as to be inclined with respect to the direction opposite to the sheet-transport direction D2 in the first sheet-transport path R1 while the side on which the sheets P are transported into the compilation tray 31 is the upper side (in the Z direction in FIG. 4), and the sheets P are stacked in order onto the placement surface 31*a*, on which the sheets P are to be placed as the stack of sheets PB, even in the case where sheet buffering is performed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A post-processing apparatus comprising:

a buffer unit that includes:

a first transport path that transports sheets, which are sent from an image forming unit, in a downstream direction of the first transport path; and a second transport path that branches off from the first transport path, the second transport path being capable of temporarily holding at least one of the sheets that comes out of the first transport path by being reversed and transported opposite to the downstream direction of the first transport path, wherein the buffer unit sequentially transports the sheets from a position below an uppermost edge of a first sheet temporarily held in the second transport path such that a second sheet becomes stacked with the first sheet and the two sheets are transported to the first transport path and the second transport path while being stacked on top of one another; and a compilation tray that is inclined relative to a vertical line passing through the second transport path such that the sheets supplied from the second transport path are transported into the compilation tray from above the compilation tray, intersect the compilation tray below a top-most edge of the compilation tray, and are stacked onto a placement surface as a stack of sheets, wherein the compilation tray is in a downstream direction of the second transport path and below the second transport path, and the sheets are placed in order onto the placement surface.

2. The post-processing apparatus according to claim 1, wherein the buffer unit sequentially transports the sheets sent from the image forming unit to the placement surface starting from an upper side such that at least two of the sheets are transported while being stacked on top of one another.

3. The post-processing apparatus according to claim 1, wherein two of the sheets are transported by the buffer unit while being stacked on top of one another.

4. The post-processing apparatus according to claim 2, wherein two of the sheets are transported by the buffer unit while being stacked on top of one another.

5. An image forming system comprising:

an image forming apparatus that forms images on sheets; and the post-processing apparatus according to claim 1 that performs saddle stitching on a stack of the sheets on which images have been formed by the image forming apparatus.

6. An image forming system comprising:

an image forming apparatus that forms images on sheets; and the post-processing apparatus according to claim 2 that performs saddle stitching on a stack of the sheets on which images have been formed by the image forming apparatus.

7. An image forming system comprising:

an image forming apparatus that forms images on sheets; and the post-processing apparatus according to claim 3 that performs saddle stitching on a stack of the sheets on which images have been formed by the image forming apparatus.

8. An image forming system comprising:

an image forming apparatus that forms images on sheets; and the post-processing apparatus according to claim 4 that performs saddle stitching on a stack of the sheets on which images have been formed by the image forming apparatus.

* * * * *